US007482760B2

(12) United States Patent
Jungwirth et al.

(10) Patent No.: US 7,482,760 B2
(45) Date of Patent: Jan. 27, 2009

(54) METHOD AND APPARATUS FOR SCALING THE AVERAGE CURRENT SUPPLY TO LIGHT-EMITTING ELEMENTS

(75) Inventors: Paul Jungwirth, Burnaby (CA); Ion Toma, Richmond (CA)

(73) Assignee: TIR Technology LP, Burnaby, British Columbia (CA)

( * ) Notice: Subject to any disclaimer, the term of this patent is extended or adjusted under 35 U.S.C. 154(b) by 722 days.

(21) Appl. No.: 11/198,248

(22) Filed: Aug. 5, 2005

(65) Prior Publication Data

US 2006/0071823 A1 Apr. 6, 2006

Related U.S. Application Data

(60) Provisional application No. 60/600,825, filed on Aug. 12, 2004.

(51) Int. Cl.
*H05B 37/00* (2006.01)

(52) U.S. Cl. ..... 315/185 R; 315/291; 315/192; 315/193

(58) Field of Classification Search ..... 315/291, 315/185 R, 192, 193, 246, 186, 189, 191, 315/307, 250

See application file for complete search history.

(56) References Cited

U.S. PATENT DOCUMENTS

| | | | | |
|---|---|---|---|---|
| 4,090,189 | A | 5/1978 | Fisler | |
| 5,598,068 | A | 1/1997 | Shirai | |
| 6,161,910 | A | 12/2000 | Reisenauer et al. | |
| 6,351,079 | B1 | 2/2002 | Willis | |
| 6,396,466 | B1 | 5/2002 | Pross et al. | |
| 6,621,235 | B2 | 9/2003 | Chang | |
| 6,717,559 | B2 | 4/2004 | Weindorf | |
| 7,081,722 | B1 * | 7/2006 | Huynh et al. | 315/323 |
| 7,265,504 | B2 * | 9/2007 | Grant et al. | 315/308 |
| 7,358,684 | B2 * | 4/2008 | Wey et al. | 315/277 |

* cited by examiner

*Primary Examiner*—David Hung Vu

(57) ABSTRACT

The present invention provides a method and apparatus for scaling the average drive current supplied to a light-emitting element or string thereof by coupling a scaling signal to an original control signal thereby generating an effective control signal for control of the light-emitting element(s). The scaling signal can be a modulated signal, for example a Pulse Width Modulation (PWM) signal, Pulse Code Modulation (PCM) signal, or other signal and modifies the original control signal to produce an effective control signal. The effective control signal is subsequently used to control the supply of power to the light-emitting element(s) from a power source via a switching device. The effective control signal essentially modifies the ON time of the light-emitting element(s), thereby modifying the average drive current passing through the light-emitting element(s). The scaling signal is coupled to the original control signal by a coupling mechanism, thereby enabling the modification of the original control signal by the scaling signal forming the effective control signal.

19 Claims, 4 Drawing Sheets

METHOD AND APPARATUS FOR SCALING THE AVERAGE CURRENT SUPPLY TO LIGHT-EMITTING ELEMENTS

CROSS-REFERENCE TO RELATED APPLICATIONS

This application claims the benefit of U.S. Provisional Patent Application No. 60/600,825, filed Aug. 12, 2004, which is hereby incorporated herein by reference.

FIELD OF THE INVENTION

The present invention relates to the field of lighting and more specifically to scaling of the average current supplied to light-emitting elements.

BACKGROUND

Recent advances in the development of semiconductor and organic light-emitting diodes (LEDs and OLEDs) have made these solid-state devices suitable for use in general illumination applications, including architectural, entertainment, and roadway lighting, for example. As such, these devices are becoming increasingly competitive with light sources such as incandescent, fluorescent, and high-intensity discharge lamps.

An advantage of LEDs is that their turn-on and turn-off times are typically less than 100 nanoseconds. The average luminous intensity of an LED can therefore be controlled using a fixed constant-current power supply together with pulse width modulation (PWM), for example, of the LED drive current, wherein the time-averaged luminous intensity is linearly proportional to the PWM duty cycle. This technique of using PWM signals is disclosed in U.S. Pat. No. 4,090,189. Today, PWM is typically the preferred method for LED luminous intensity control in that it offers linear control over a range of three decades (1000:1) or more without suffering power losses through current-limiting resistors, uneven luminous intensities in LED arrays, and noticeable colour shifts as identified by Zukauskas, A., M. S. Schur, and R. Caska, 2002, *Introduction to Solid-State Lighting*. New York, N.Y.: Wiley-Interscience, p. 136. The PWM signals used to control the LEDs are preferably generated by microcontrollers and associated peripheral hardware.

According to U.S. Pat. No. 4,090,189, a plurality of LEDs can be connected in parallel with their anodes connected to a common voltage supply, and their cathodes each connected to a different fixed resistor and switch. The fixed resistors can serve to limit the peak current through each LED when the corresponding switches are closed. Practically however, this only works well if the forward voltage of each LED is nearly identical, otherwise different values of resistors must be chosen for each different LED to prevent current hogging by any one LED in this parallel configuration. This use of resistors can also induce large losses thus reducing the overall efficiency of the circuit.

Alternately, as in U.S. Pat. No. 6,621,235, a technique of using transistor current mirrors for each parallel string of LEDs is described as a way to equalize the current shared by each string. Another technique is disclosed in U.S. Pat. No. 5,598,068, which sets up multiple independent current sources for each parallel string of LEDs. These techniques however, typically use a large number of components and have a low efficiency.

Another means to address forward voltage differences in parallel strings is through forward voltage binning which is not necessarily practical in terms of the additional step during the production process. This procedure can additionally result in wasted parts.

In addition, with the invention of high brightness light-emitting diodes (HBLEDs) and the desire to use many of them in luminaires for architectural or general illumination results in LED circuits with a plurality of parallel strings, each containing a plurality of LEDs. Due to manufacturing tolerances, as well as fundamental differences between the device chemistries of LEDs of different colours, the forward voltage of different LEDs can vary by up to approximately 1.6 volts. This disparity in forward voltage requirements can be compounded when several of these LEDs are stacked in series, with the result being that parallel strings of the same number of LEDs can have large forward voltage drops. Driving LEDs using the above cited techniques means that the common voltage source must be of a high enough voltage to bias the LED string with the largest forward voltage drop. As a result, the LED strings with a lower forward voltage requirement will have excess voltage, which will result in excess power dissipated by the components in series with the LEDs that are used to limit the current across the LED string with the lower forward voltage drop. If this form of dissipation was not provided, excess current will flow through the LED string with the lower forward voltage drop which can overdrive the LED string and result in LED damage.

An advantage of PWM techniques is that the average LED current can be efficiently controlled by reducing the duty cycle of the PWM switching signal to prevent exceeding the maximum rated average current. In practice however, this means that if LEDs, or strings of LEDs, with different forward voltages are in parallel with each other, all drawing power from a single voltage source, the highest forward voltage string can be fully dimmed from 0 to 100%, whereas the lower forward voltage string must be driven with a maximum duty cycle, $D_{max}$, of less than 100% to prevent overdriving. FIG. 1 shows a lighting system configuration in which a microcontroller or similar device 13 is used to generate PWM signals for each LED string 11 to 12, each drawing power from voltage source 10. This configuration has two problems. First, assuming the PWM signal generator 13 has 8 bit accuracy, for example, which can provide 256 discrete dimming levels for 0 to 100%, then for the strings with $D_{max}$<100%, the dimming resolution would be significantly reduced. For example, if the maximum 'safe' duty cycle was 75% for a particular LED string, then the number of discrete dimming levels for that string would be reduced to 75%×256=192. Secondly, firmware can become more complicated since different LED strings must be driven with different duty cycles to achieve the same level of effective dimming, thereby resulting in a requirement for custom calibration factors to be determined for each LED string for storage in EEPROM (electrically erasable programmable read-only memory), for example. These problems would also typically apply to any other digital control method known in the art that could be used to vary LED brightness, for example, Pulse Code Modulation (PCM).

Therefore, there is a need for a low cost and efficient method and apparatus for scaling the current provided to LEDs and other light-emitting elements that allows each type of light-emitting element to be dimmed from 0% to 100%, without the need for complicated firmware.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a method and apparatus for scaling the average current supply to light-emitting elements. In accordance with an aspect of the present invention, there is provided a light-emitting element driving apparatus for driving two or more strings of one or more light-emitting elements, said apparatus comprising: one or more control signal generators for generating two or more original control signals; one or more scaling signal generators for generating one or more scaling signals; one or more coupling means, a particular coupling means receiving one of the original control signals and a particular scaling signal, each coupling means generating an effective control signal for control of a particular string by coupling the received scaling signal to the received original control signal; and switching means associated with each string, the switching means adapted for connection to a power source, and each switching means responsive to a particular control signal for controlling power supplied to a particular string, wherein the particular control signal is either one of the two or more original control signals or the effective control signal generated by one of the one or more coupling means; thereby driving said two or more strings of one or more light-emitting elements.

In accordance with another aspect of the invention, there is provided a method for driving two or more strings of one or more light-emitting elements, said method comprising the steps of: generating two or more original control signals; generating one or more scaling signals; independently coupling each scaling signal with one of the two or more original control signals, thereby generating one or more effective control signals; transmitting a particular control signal to each string of one or more light-emitting elements for controlling power supplied to each string, wherein the particular control signal is either one of the two or more original control signals or one of the one or more effective control signals; thereby driving said two or more strings of one or more light-emitting elements.

DETAILED DESCRIPTION OF THE INVENTION

Definitions

Figure 1:
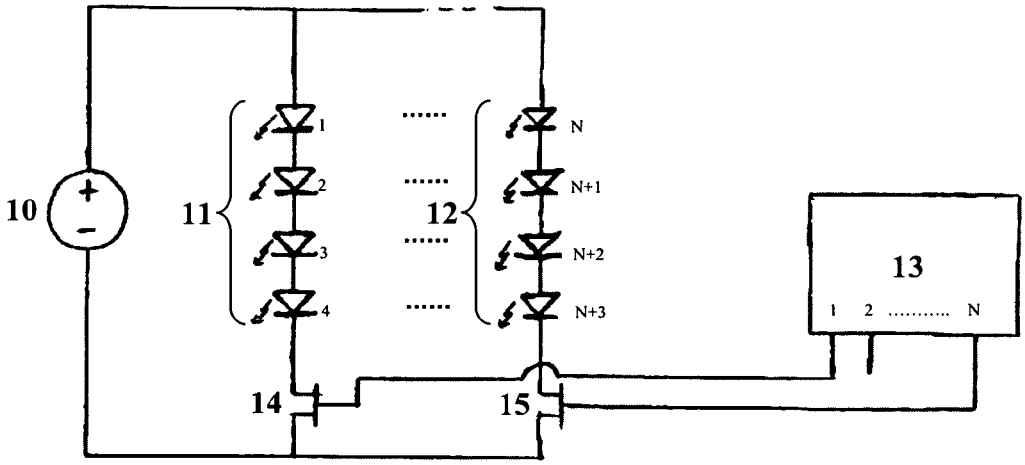
FIGURE 1 (Prior Art)
FIG. 1 illustrates a prior art circuit for driving strings of LEDs in parallel using PWM switching for dimming and current control.

The term "light-emitting element" is used to define any device that emits radiation in any region or combination of regions of the electromagnetic spectrum for example the visible region, infrared and/or ultraviolet region, when activated by applying a potential difference across it or passing a current through it, for example. Examples of light-emitting elements include semiconductor, organic, polymer, phosphor-coated or high-flux light-emitting diodes or other similar devices as would be readily understood.

The term "power source" is used to define a means for providing power to an electronic device and may include various types of power supplies and/or driving circuitry.

Unless defined otherwise, all technical and scientific terms used herein have the same meaning as commonly understood by one of ordinary skill in the art to which this invention belongs.

The present invention provides a method and apparatus for scaling the average drive current supplied to a light-emitting element or string thereof by coupling a scaling signal to an original control signal thereby generating an effective control signal for control of the light-emitting element(s). The scaling signal can be a modulated signal, for example a Pulse Width Modulation (PWM) signal, Pulse Code Modulation (PCM) signal, or other signal as would be readily understood, and modifies the original control signal to produce an effective control signal. The effective control signal is subsequently used to control the supply of power to the light-emitting element(s) from a power source via a switching means, for example a FET switch, BJT switch or any other switching means as would be readily understood. The effective control signal essentially modifies the ON time of the light-emitting element(s), thereby modifying the average drive current passing through the light-emitting element(s). The scaling signal is coupled to the original control signal by a coupling means, thereby enabling the modification of the original control signal by the scaling signal forming the effective control signal. In one embodiment an AND logic gate can be used as the coupling means.

Light-emitting elements such as light-emitting diodes (LEDs) typically have a maximum rated average current. For example, state-of-the-art high-flux, one-watt LED packages have a maximum rating for average and instantaneous current of approximately 350 mA and 500 mA, respectively. Exceeding this maximum average current rating can compromise the life of the light-emitting elements. Therefore, a method of current scaling according to the present invention can be useful when a single common voltage drives a plurality of strings of light-emitting elements with each string having a different forward voltage and different maximum average current rating, for example. The present invention enables the average current supplied to each string of light-emitting elements to be scaled thus providing a means for preventing the maximum current ratings of each light-emitting element string from being exceeded.

Figure 2:
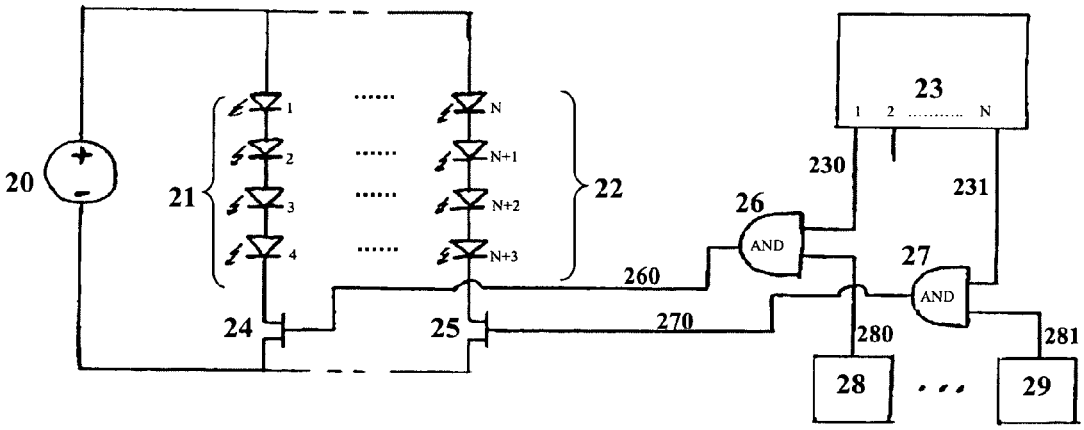
FIG. 2 illustrates a configuration of an LED drive circuit using PWM switching for dimming and current control including circuitry for current scaling, according to one embodiment of the present invention.

In one embodiment of the present invention, as illustrated in FIG. 2, scaling signals 280 to 281 are coupled to the original control signals 230 to 231 for each light-emitting element string 21 to 22 using AND logic gates 26 to 27, respectively. A control signal generator 23 generates 1 to N original control signals 230 to 231 for light-emitting element strings 21 to 22. Each original control signal is generated in a digital format and enables control of a corresponding string of light-emitting elements. Signal generators 28 to 29, which may be free running square wave oscillators, for example, produce scaling signals 280 to 281. The effective control signals 260 to 270, which are voltage signals, are output from AND gates 26 to 27, and are then provided to switching means 24 to 25, for example transistor switches, respectively, which control the supply of power to the light-emitting element strings 24 to 25 from the single voltage source 20. In this manner, independent scaling of the average current supplied to each light-emitting element string 21 to 22 can be enabled. The transistor switches can be a FET switch, BJT switch, relay or any other switch as would be readily understood by a worker skilled in the art.

Figure 3:
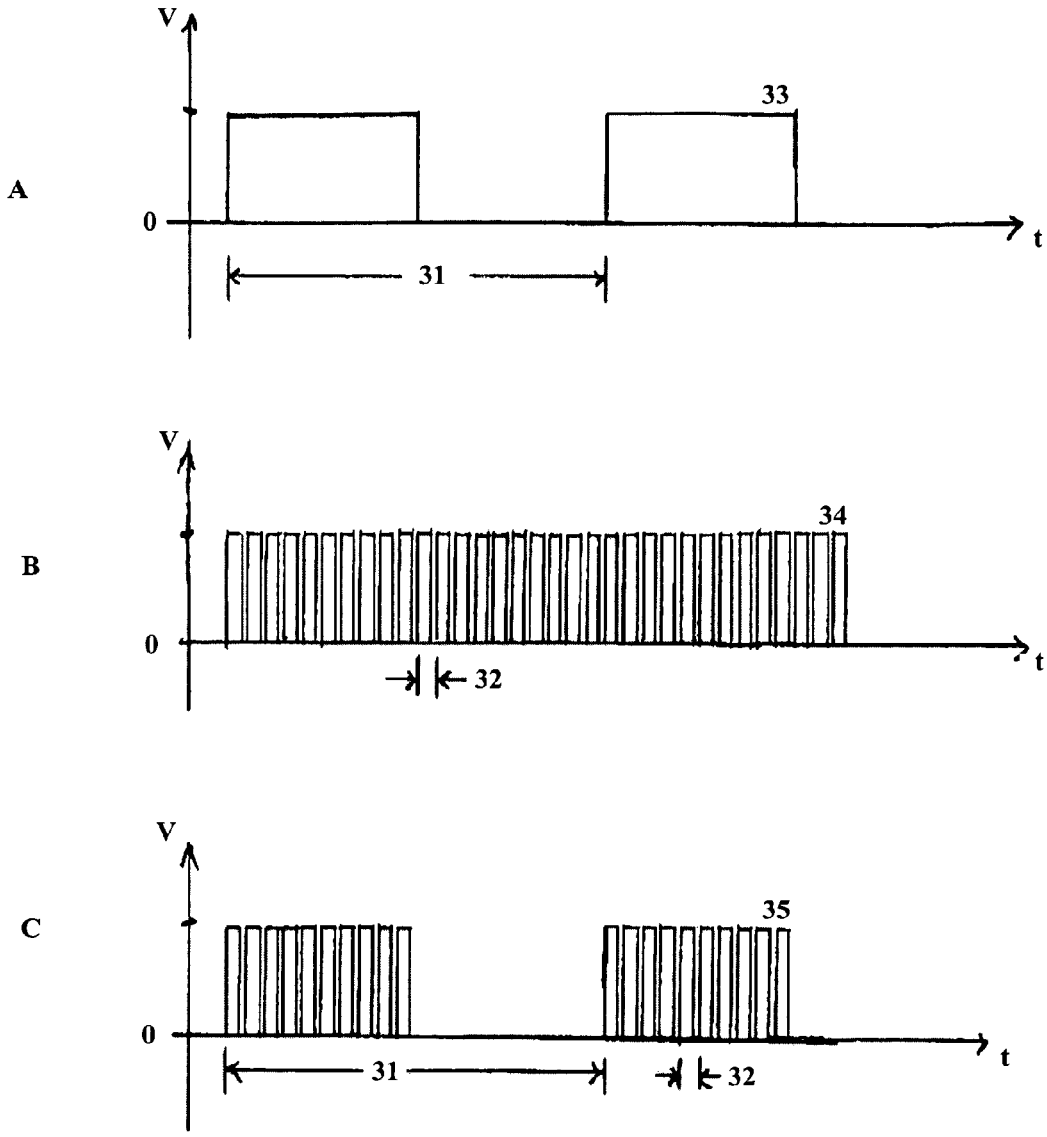
FIG. 3A illustrates an original control signal according to one embodiment of the present invention.
FIG. 3B illustrates a scaling signal according to one embodiment of the present invention.
FIG. 3C illustrates an effective control signal according to one embodiment of the present invention.

In one embodiment of the present invention, the scaling signal is modulated between two states, an ON state and an OFF state, and can be of particular duty cycles. The scaling signal is used to reduce the ON time of the original control signal thereby reducing the average current supplied to the light-emitting element(s). For example, in one embodiment as illustrated in FIGS. 3A to 3C, the scaling signal 34 (FIG. 3B) is coupled to the original control signal 33 (FIG. 3A) such that the effective control signal 35 (FIG. 3C) is obtained. Use of this effective control signal 35 results in a lower average drive current being supplied to the light-emitting element(s) than would be obtained using the original control signal 33. In this embodiment, the original control signal 33 has a particular frequency and corresponding period 31 and a duty cycle of 50%. Scaling signal 34 has a higher frequency and a corresponding smaller period 32 and a duty cycle of 75%. Therefore, when scaling signal 34 is coupled to the original control signal 33, such that effective control signal 35 is obtained, the effective control signal 35 has a duty cycle that is 25% less than original control signal 33. Therefore, the average current supplied to the light-emitting elements as a result of effective control signal 35 is 25% less than what would result from original control signal 33 since the ON time of the effective control signal 35 is 25% less than that of the original control signal 33. In this example, if a single voltage drives two light-emitting element strings, one string can have a maximum average current rating that is 75% of the other string. The duty cycle of the original control signals and scaling signals can thus be varied as desired to accommodate light-emitting element strings or light-emitting elements with varying forward voltages and average current ratings.

In other embodiments any number of light-emitting elements may be present per string and any number of strings may be driven by a single voltage source. The type of scaling signals and original control signals may also vary in other embodiments. Furthermore, any number of scaling signal generators may be combined to provide the same scaling signal for multiple strings if so desired. In addition, any number of original control signals may be combined to provide the same control signal to multiple strings if desired. According to the present invention, the number of light-emitting elements per string need not be equal, however, if they are equal, the relative difference in total forward voltage drop per string may be reduced, thereby reducing the level of current scaling required.

In another embodiment, a ratio of Red:Green:Blue (RGB) light-emitting elements may be chosen such that when all strings are run at 100% duty cycle, the combined luminous output is white light. This result may not be achievable if the number of light-emitting elements in each string is equal, as it would also depend on the relative output of the various light-emitting elements. In the case where the number of light-emitting elements per string is not equal, the forward voltage differences would likely be greater than a string with fewer light-emitting elements, thus requiring more current scaling.

In yet another embodiment of the present invention, one string of red light-emitting elements, one string of blue light-emitting elements, and one string of green light-emitting elements form a dimmable RGB lighting system with the output power supply chosen to match the string with the largest forward voltage drop. The present invention can enable modification of the control signals to the two light-emitting element strings with the lower forward voltage drops when compared to the third string, thereby reducing the current applied to the respective light-emitting element strings as required.

Coupling Means

Figure 4:
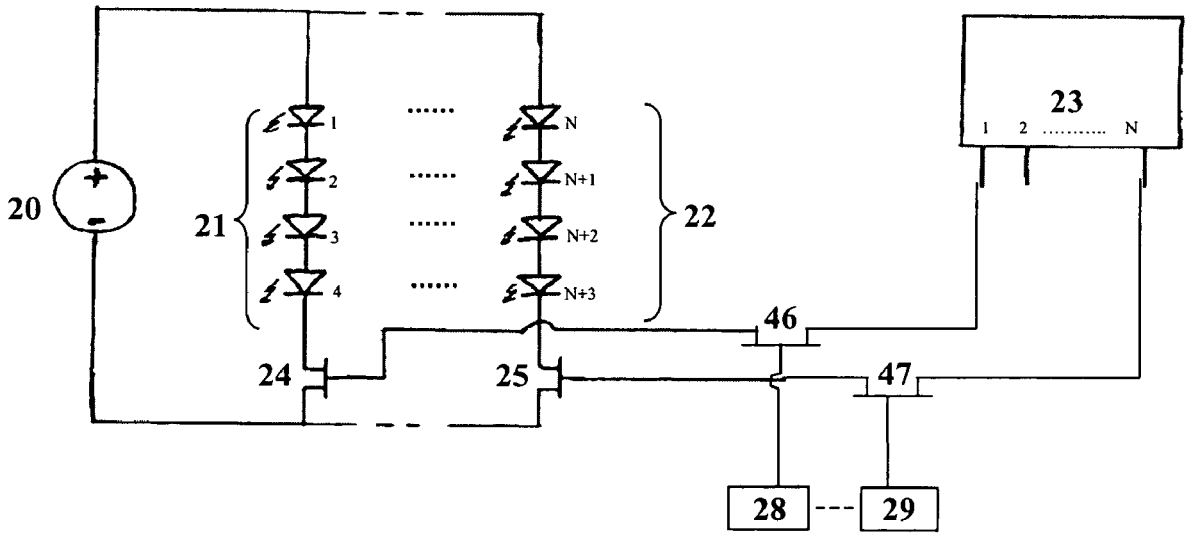
FIG. 4 illustrates a configuration of an LED drive circuit using PWM switching for dimming and current control including circuitry for current scaling, according to another embodiment of the present invention.

The scaling signal can be coupled to the original control signal for control of a light-emitting element in various ways. For example, as described earlier, in one embodiment an AND function can be performed on the scaling signal and original control signal to produce the effective control signal which would subsequently be provided to the switching means used for control of the light-emitting element(s). In another embodiment, a function equivalent to an AND function, such as an inverted NAND function or any other function or combination of functions with an AND function result, can be integrated into the present invention. A worker skilled in the art would readily understand a function or combination of functions that may be used to couple the scaling signal and original control signal in the desired AND result manner. In yet a further embodiment as illustrated in FIG. 4, the scaling signal may be used to control switches, for example FET switches 46 to 47, subsequent to the generation of the original control signal by device 23. In this manner the transmission of the original control signal to the light-emitting elements is controlled by the control switch which is responsive to the scaling signal. In further embodiments of the present invention, other methods of coupling the original control and scaling signals may also be used, for example operational amplifier circuitry can be used as the coupling means, provided this circuitry is designed to have an AND result.

Original Control Signal

The original control signal may be any signal that can be used for the control of light-emitting elements. For example, the control signal may be a PWM signal, a PCM signal, a FM or frequency modulated signal, a constant signal, a linearly increasing or decreasing signal, a non-linear increasing or decreasing signal, or any other signal as would be readily understood by a worker skilled in the art. In one embodiment, the original control signal may provide a full 0% to 100% range of dimming control of the light-emitting element(s) by varying the duty cycle of a PWM control signal over time. In another embodiment dimming control can be achieved by means of an original control signal that increases or decreases in magnitude over time. Various embodiments of the original control signal may require a particular coupling means to be used, for example, an appropriate coupling means for coupling a scaling signal to an increasing original control signal, may be to apply the scaling signal to a FET switch subsequent to the original control signal generation.

In embodiments in which a PWM signal, PCM signal, or similar signal is used to control the light-emitting element(s), it is desirable that the frequency of the original control signal be large enough to prevent visual flicker or other form of flicker effect of the illumination created. The amplitude of the original control signal may be determined according to the appropriate amplitude required to control the switching means that in turn controls the light-emitting elements.

The original control signals are generated by a control signal generator that can autonomously generate the 1 to N original control signals as illustrated in FIG. 2. Alternately, the control signal generator can be responsive to one or more input signals that are provided thereto for the generation of the original control signals. For example, the control signal generator can receive one or more digital signals providing information relating to the manner in which the original control signals are to be generated. Alternately, the control signal generator can receive one or more analog signals which, upon conversion into a digital format by an analog-to-digital converter, can be used for the generation of the original control signals. In this embodiment, the analog-to-digital converter can be integrated into the control signal generator or may alternately be a separate entity that is connected to the control signal generator, as would be readily understood by a worker skilled in the art. In one embodiment of the present invention, the control signal generator is a microprocessor and in an alternate embodiment the control signal generator comprises an analog-to-digital converter and a microprocessor.

Scaling Signal

The scaling signal may be any signal that can effectively scale the original control signal used to control the activation and deactivation of light-emitting element(s), when the scaling signal is coupled to the original control signal. As described above in the embodiment illustrated in FIG. 2, the scaling signal can decrease the ON time of the light-emitting element strings being controlled, thereby decreasing the average current supplied to the light-emitting element strings. Therefore, in the embodiment according to FIG. 2, the voltage source 20 may be selected such that it provides a sufficient voltage drop for the string with the maximum required forward voltage. Scaling signals with appropriate duty cycles can then be coupled to each control signal to reduce the ON time of the control signals to a level that provides an average current appropriate for each particular string of light-emitting elements 21 to 22. This scaling of the average current can be done without incurring the typical power losses associated with current limiting resistors, for example, while still allowing for the desired dimming control such as PWM dimming control, with full resolution, and relatively easy firmware implementation.

The scaling signal may be a modulated signal for example a pulsed digital signal, wherein this pulsed digital signal can be a PWM signal, PCM signal, frequency modulation signal or similar signal as would be known to a worker skilled in the art. In one embodiment, the frequency of the scaling signal is higher than the frequency of the original control signal to prevent aliasing.

The amplitude of the scaling signal may be smaller, larger or the same as the original control signal and can depend on the coupling means used. For example, if an AND function is used to couple the scaling signal to the original control signal, a scaling signal amplitude that is the same as the amplitude of the original control signal may be desired. This amplitude value would be appropriate for control of the switching means used to control the activation and deactivation of the light-emitting elements. If however, a switch, as illustrated in FIG. 4, were used to couple the scaling signal to the control signal, an amplitude of the scaling signal that is appropriate for controlling the particular switch used would be desired.

In one embodiment the scaling signals are generated by free running square wave oscillators. In another embodiment the scaling signal may be generated using a timer circuit capable of producing signal having a fixed duty cycle or a timer circuit capable of producing a signal having an adjustable duty cycle. For example, a fixed timer circuit can be designed comprising a timer chip for pulse generation and fixed resistors and fixed capacitors defining a fixed duty cycle. Alternately an adjustable timer circuit can be designed comprising a timer chip for pulse generation and fixed capacitors and variable resistors for enabling the adjustment of the duty cycle, for example. Other types of appropriate timer circuits and timer circuit configurations would be readily understood by a worker skilled in the art. A timer circuit that may be used for the generation of a scaling signal utilizes a LM555 timer chip in the timer circuit, for example. Other appropriate timer chips would be readily understood by a worker skilled in the art.

In yet another embodiment, the scaling signals may be generated by available outputs on the microprocessor used to generate the original control signals. The duty cycles of these scaling signals may be stored in ROM and generated by firmware. The amount of external hardware required for this embodiment can therefore be reduced. Alternately, the scaling signals may be generated using an FPGA (Field Programmable Gate Array) with a microcontroller core, an example of which is an Altera Cyclone FPGA.

In one embodiment, a scaling signal generator can be calibrated for use with a particular light-emitting element or string thereof, wherein the generated scaling signal is representative of the difference between the forward voltage output from the power source, compared with the voltage drop over the light-emitting element or string thereof with which the scaling signal generator is associated. Alternatively, a scaling signal generator can produce a desired scaling signal in response to one or more control signals from an external source.

It would be readily understood by a worker skilled in the art that if the original control signal generated was appropriate for control of a particular string of light-emitting elements, scaling of this original control signal may not be required. For example, if the power supply has been tuned to supply power to the string of light-emitting elements with the largest forward voltage drop, scaling of the original control signal for control of this string of light-emitting elements may not be required.

The embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A light-emitting element driving apparatus for driving two or more strings of one or more light-emitting elements, said apparatus comprising:

a) one or more control signal generators for generating two or more original control signals;

b) one or more scaling signal generators for generating one or more scaling signals;

c) one or more coupling means, a particular coupling means receiving one of the original control signals and a particular scaling signal, each coupling means generating an effective control signal for control of a particular string by coupling the received scaling signal to the received original control signal; and d) switching means associated with each string, the switching means adapted for connection to a power source, and each switching means responsive to a particular control signal for controlling power supplied to a particular string, wherein the particular control signal is either one of the two or more original control signals or the effective control signal generated by one of the one or more coupling means;

thereby driving said two or more strings of one or more light-emitting elements.

2. The light-emitting element driving apparatus according to claim 1, wherein one or more coupling means is an AND logic gate or an inverted NAND logic gate.

3. The light-emitting element driving apparatus according to claim 1, wherein one or more coupling means is a control switch operatively responsive to the scaling signal, the control switch controlling transmission of the original control signal to one of the one or more stings.

4. The light-emitting element driving apparatus according to claim 1, wherein one or more scaling signal generators is a free running square wave oscillator.

5. The light-emitting element driving apparatus according to claim 1, wherein one or more scaling signal generators is a timer circuit.

6. The light-emitting element driving apparatus according to claim 5, wherein the timer circuit generates one or more scaling signals having a fixed duty cycle.

7. The light-emitting element driving apparatus according to claim 5, wherein the timer circuit generates one or more scaling signals having an adjustable duty cycle.

8. The light-emitting element driving apparatus according to claim 1, wherein one or more scaling signal generators is an operational amplifier circuit configured with an AND result.

9. The light-emitting element driving apparatus according to claim 1, wherein one or more scaling signal generators is a Field Programmable Gate Array with a microcontroller core.

10. The light-emitting element driving apparatus according to claim 1, wherein the one or more scaling signal generators autonomously generate one or more scaling signals.

11. The light-emitting element driving apparatus according to claim 1, wherein the one or more scaling signal generators generate one or more scaling signals in response to one or more input signals received thereby.

12. The light-emitting element driving apparatus according to claim 1, wherein one of the one or more scaling signal generators generates scaling signals for two or more strings.

13. The light-emitting element driving apparatus according to claim 1, wherein each of the one or more scaling signals is a pulsed digital signal selected from the group comprising pulse width modulation signal, pulse code modulation signal and frequency modulation signal.

14. The light-emitting element driving apparatus according to claim 1, wherein each of the one or more original control signals is a signal selected from the group comprising pulse width modulation signal, pulse code modulation signal, frequency modulated signal, constant signal, linearly increasing signal, linearly decreasing signal, non-linear increasing signal and non-linear decreasing signal.

15. The light-emitting element driving apparatus according to claim 1, wherein the switching means is a transistor switch.

16. The light-emitting element driving apparatus according to claim 15, wherein the transistor switch is selected from the group comprising a FET switch, BJT switch and relay.

17. The light-emitting element driving apparatus according to claim 1, wherein the scaling signal has a first frequency and a respective original control signal has a second frequency, wherein the first frequency is greater than the second frequency.

18. The light-emitting element driving apparatus according to claim 1, wherein the one or more scaling signals and the one or more original control signals are generated by a microprocessor.

19. A method for driving two or more strings of one or more light-emitting elements, said method comprising the steps of:

a) generating two or more original control signals;

b) generating one or more scaling signals;

c) independently coupling each scaling signal with one of the two or more original control signals, thereby generating one or more effective control signals;

d) transmitting a particular control signal to each string of one or more light-emitting elements for controlling power supplied to each string, wherein the particular control signal is either one of the two or more original control signals or one of the one or more effective control signals;

thereby driving said two or more strings of one or more light-emitting elements.

* * * * *